US006145167A

United States Patent [19]

Brentini

[11] Patent Number: 6,145,167

[45] Date of Patent: Nov. 14, 2000

[54] PERFECTED LABEL WHICH CAN BE ATTACHED TO A COMMERCIAL ARTICLE TO EMIT AN ALARM SIGNAL, AND RELATIVE DEVICE FOR DETACHING THE LABEL FROM THE ARTICLE WHERETO IT IS ATTACHED

[76] Inventor: Attilio Brentini, 46, Avenue Rochettaz, 1009 Pully, Switzerland

[21] Appl. No.: 09/210,728

[22] Filed: Dec. 15, 1998

[30] Foreign Application Priority Data

Dec. 17, 1997 [IT] Italy ..... MI970904 U

[51] Int. Cl.[7] ..... A44B 21/00

[52] U.S. Cl. ..... 24/3.1; 24/3.3; 24/3.13; 24/16 PB; 283/72; 283/74; 283/80; 40/297.01; 40/300; 40/665

[58] Field of Search ..... 283/72, 74, 80, 283/75; 40/297.01, 300, 665, 663, 304, 27, 642.2; 24/16 PB

[56] References Cited

U.S. PATENT DOCUMENTS

| | | | |
|---|---|---|---|
| 3,214,808 | 11/1965 | Litwin | 40/665 |
| 5,337,503 | 8/1994 | Goby | 40/665 |
| 5,387,012 | 2/1995 | Hibbs | 283/81 |
| 5,791,079 | 8/1998 | Mazzucchelli | 40/625 |

*Primary Examiner*—Andrea L. Pitts
*Assistant Examiner*—Daniel Phan
*Attorney, Agent, or Firm*—Young & Thompson

[57] ABSTRACT

A label which can be attached to a commercial article for the emission of an alarm signal, includes a body of the label containing a device which can be perceived by suitable detection equipment for emission of an alarm signal, a band for attachment to the article for connecting the body of the label to the article, and a structure for restraining the band and the body of the label firmly one to the other. The label body includes a housing suitable for being entered by the band. The band has an end band section and an intermediate section which oppose each other and are compressed one in relation to the other in the housing. The band has, along at least part of one longitudinal face, securing teeth so that the portions of securing teeth on the parts of the band in contact in the housing are compressed against each other in such a way as to block relative sliding of the portions of the band in the housing during an attempt to disengage the article from the band.

18 Claims, 2 Drawing Sheets

PERFECTED LABEL WHICH CAN BE ATTACHED TO A COMMERCIAL ARTICLE TO EMIT AN ALARM SIGNAL, AND RELATIVE DEVICE FOR DETACHING THE LABEL FROM THE ARTICLE WHERETO IT IS ATTACHED

FIELD OF THE INVENTION

The present invention relates to a label which can be attached to a commercial article to emit an alarm signal, as well as a device suitable for achieving disengagement of the label from the article whereto it is attached.

BACKGROUND OF THE INVENTION

Such a kind of label has been made the subject of a previous Italian patent application No. MI97A 002319, also owned by the present applicant. The present invention relates to improvements made to the label described in the prior patent application.

More particularly, the present invention provides a label of the type referred to above whereby it is possible to secure the band around the article effectively and without risk of withdrawal of the label from the object whereto it is attached.

SUMMARY OF THE INVENTION

The previous objective is achieved by a label having the features claimed herein.

The fact that portions of the toothing of the securing band, which come into contact one with the other and are pressed strongly in the housing for insertion of the label, blocks any relative sliding of the portions of band in the housing with particular efficacy, and avoids any risk of loosening of the securing band and consequent fraudulent removals of the label from the article whereto it is attached.

A device for disengaging the label from the article whereto it is attached is also described.

BRIEF DESCRIPTION OF THE DRAWINGS

The present invention, together with further features and advantages, will in any case be made clearer on reading the following description, relating to preferred embodiments to be read with reference to the accompanying drawings, in which.

DESCRIPTION OF PREFERRED EMBODIMENTS

Figure 1:
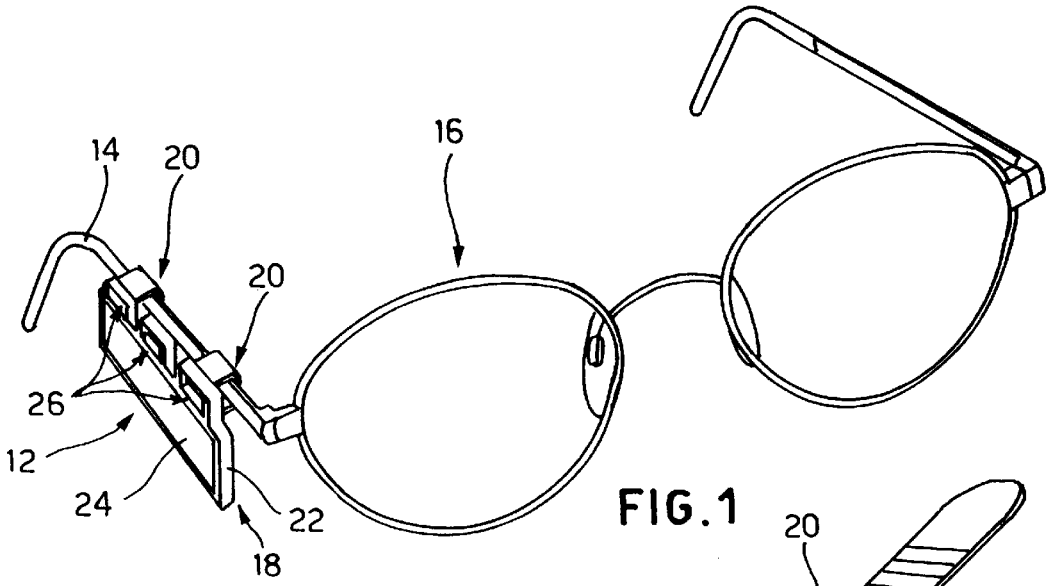
FIG. 1 is a perspective view showing the label attached to a pair of eyeglasses.

FIG. 1 shows a preferred application of the present label for emitting an alarm signal for preventing and signalling the theft of eyeglasses displayed to the public in a sales outlet.

As indicated in FIG. 1, the label 12 for holding the signalling element is firmly attached to a shaft 14 of eyeglasses 16 so as to rest, when the eyeglasses are worn during a test, at a distance from the face of the wearer and do not disturb or interfere with this test process.

Figure 2:
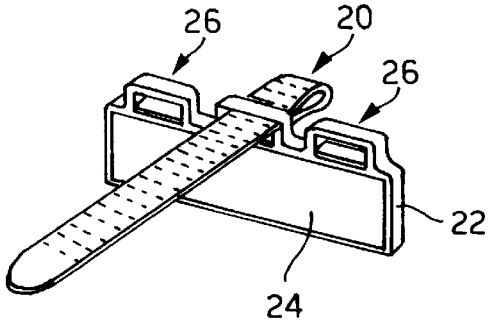
FIG. 2 is a perspective view of the label without the article attached.

With reference also to FIG. 2, the label essentially comprises a body of the label 18, capable of containing means (not shown in the figures) which can be perceived by suitable detection apparatus for the emission of an alarm signal and a series of bands 20 for attachment to a portion of the article and the body of the label 18 to the same article. The bands 20 are restrained to the body 18 of the label by suitable restraining means which will be illustrated in greater detail hereinbelow.

The body 18 of the label has a prismatic shape with a rectangular base defined by the prismatic box or container 22, which is closed by a lid 24 to define an internal chamber for housing a device for emission of a signal which can be perceived and used by suitable apparatus for detection and emission of a possible alarm signal.

Inside the body of the label, an electroacoustic device is preferably inserted, having a vibrating portion for emission of an acoustic signal which can be perceived by appropriate detectors or other suitable devices, such as for example a magnetic bar of the type generally known in the field.

Obviously the shape and structure of the containing body 18 may be of any suitable type, also different from that of the preferred embodiment shown here.

The prismatic body of the label 18 is formed preferably in a rigid plastic material, while the bands 20 are preferably made in an extremely soft and flexible plastic material in order to surround and secure portions of the article, whereto the label is attached, of any shape and size, also extremely small in size, without any risk of withdrawal of the item from the securing band.

Although not expressly shown in the figures, on the external faces of the body 18 of the label appropriate trademarks and brands may be reproduced.

As shown in the present embodiment, the means for reciprocal restraint between the band 20 and the prismatic body of the label 18 comprise, on the label body, a triad of housings 26 projecting from the same side of the body of the label and aligned one with the other which are suitable for receiving a respective band 20 therethrough, and portions, which can be engaged reciprocally, in the housings 26 and on the bands 20, respectively.

In particular, provision is made for the engaging portion of the attachment band to be arranged in such a way as to be accessible from the outside in order to be cut and allow removal of the band from the label body, without it being necessary to break or disassemble the prismatic body of the label.

The use of a higher number of attachment bands than the individual band provided in the embodiment of the Italian application MI97A002319 leads to greater security in the restraining of the label to the article whereto it is attached. Even in the case wherein a band is faulty or in the case of faulty attachment of a band, the presence of at least one other attachment band avoids the risks of removal of the label from the article.

A safer grip is obtained also in the case wherein the band has to surround objects of extremely small diameter, such as for example shafts for eyeglasses which are particularly thin. In this case, the co-operation of several bands allows an overall action to be provided to oppose withdrawal, which is much greater than that which can be obtained with a single band. Therefore, in extreme cases wherein a single band would not be capable of effectively opposing removal along the axis of the portion of object to be restrained, the synergy developed by a series of bands enables firm restraint without the possibility of withdrawal of the object whereto the label is attached.

Figure 3:
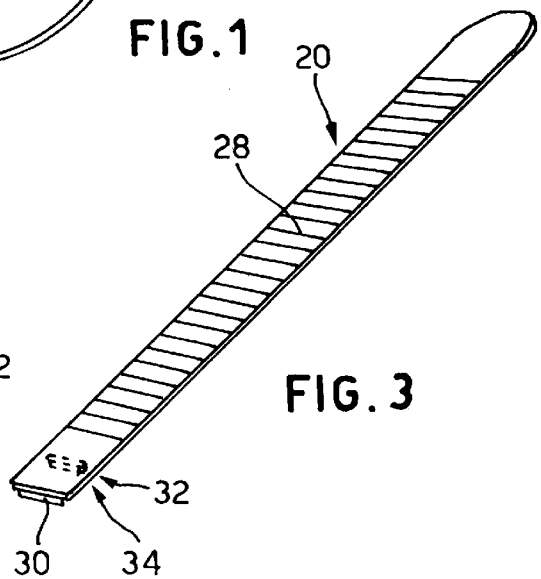
FIG. 3 is a perspective view of only the band for attaching the label of the present invention.

As shown in FIG. 3, the attachment band 20 is in the form of an elongated element, which has securing toothing 28, as well as a first and second projection, 30 and 32 respectively, at a tail end 34 of the band, used for engaging the band with the prismatic body 18 of the label. The securing toothing 28 is made to project from the longitudinal surface of the original body of the band, on the side opposite to that wherefrom the aforementioned projections 30 and 32 project transversely from the longitudinal face of the band 20.

Figure 4:
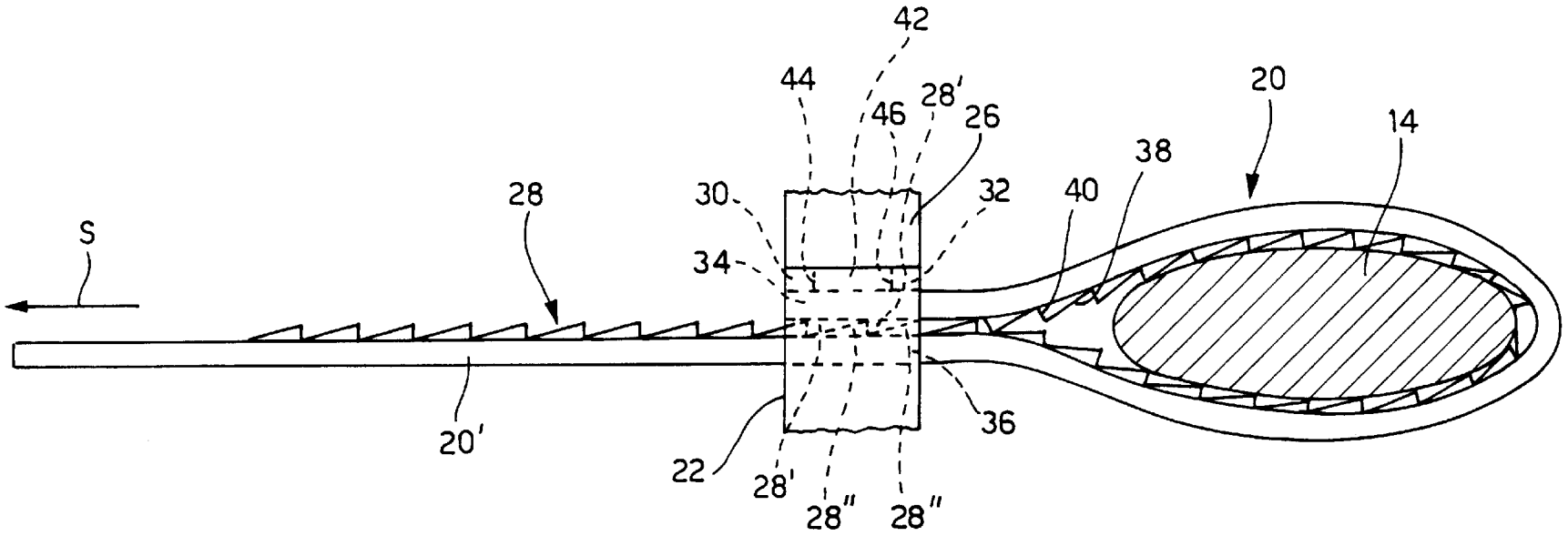
FIG. 4 represents the label in an assembled condition, and the condition of attachment to the commercial article in a sectioned view.

Referring to FIG. 4, it can be seen how each individual securing band 20 has, during use, an end section 34 of the band and an intermediate section 36 of the same which oppose each other and are compressed one in relation to the other in the housing 26 so that portions of toothing 28 situated on the opposing sections of the band are in turn pressed strongly one against the other. This allows any relative sliding between the portions of the band compressed in the housing to be effectively blocked and any undesirable disengagement of the band from the article whereto it is attached to be prevented.

The securing toothing 28 comprises a plurality of longitudinally aligned teeth each having a saw tooth shape including a longitudinal slanting slide section 38 and a transverse end section 40 for locking so that, should the band 20 be pulled longitudinally, in the direction marked by the arrow S in FIG. 4, to obtain securing of the band around the portion of article to be engaged 14, the teeth of the two band portions 20, which oppose each other in the housing 26, slide freely one on the other due to the sliding engagement between the respective longitudinal slanted sections 38, while traction exerted on the band in the direction opposite that of securing brings the transverse sections 40 of the band portions 20 into contact in the housing 26, thereby effectively preventing any relative sliding of the teeth, which are engaged one with the other, in the case of force exerted in the direction to loosen the band from the object 14 whereto it is attached.

During the action of blocking sliding of the band, it is sufficient for at least one pair of teeth, meshing one with the other, to be reciprocally engaged in the housing 26. Advantageously, according to the embodiment shown, it is preferable that two pairs of opposing teeth 28' and 28" are meshing one with the other and that 28' and 28", respectively, are reciprocally engaged in the housing 26.

The housings 26 are in the form of a hole open at the ends and wherein a protuberance 42 is formed, having a face 44 for engaging the portion 30 provided on the tail of the band, as well as having a further face 46, opposite the face 44, for engaging the other transverse portion 32 of the band housed in the housing.

With the aid of FIG. 4, it is possible to understand how attachment of the label to the required article takes place first by inserting, for a first time, the band 20 in the hole or housing 26 until the engaging portions 30 and 32, at the tail of the band, abut the opposing engaging portions 44 and 46 provided in the housing.

Subsequently, the band 20 is wrapped around the shaft 14 of the eyeglasses and the band is returned, in an overturned position, into the hole or housing 26 to exit from the side opposite the one of insertion. The band 20 is then firmly tightened around the shaft 14, exploiting co-operation between the teeth 28' and 28" of the opposing sections of the band in the housing 26. As already discussed, the arrangement of the saw teeth mentioned are such so as to allow the band only to slide towards the side opposite that of the shaft and does not allow, in any way, any return movement of the band in the direction of the shaft 14. In this way firm securing of the band around the shaft 14 of the eyeglasses is obtained.

The through hole 26 defining the housing has a substantially rectangular shape, with width or height of the hole 26 being equal to approximately twice the height of the band, in such a way as to allow insertion with pressure of two of the overlapping layers of the band, and maintaining of the parts of the band in the housing in mutual compression so as to achieve a firm securing of the band in the housing of the body of the label.

The face 44 of the protuberance 42 for engaging the projection 30 of the band is positioned to be recessed in relation to the edge of the insertion hole and enables, in an engaging condition, the tail end 34 of the band to be entirely contained in the hole or housing 26.

Following securing, the top 20' of the band projecting from the side opposite the one of attachment is cut by means of a suitable device, for example scissors.

The abovementioned protuberance 42, extending transversely across the longitudinal body of the band on the same side as the engaging protuberance 30, has the function of preventing any retraction or sliding backwards of the tail 34 of the band once it is inserted in the housing. Retraction by making the rear part of the tail having the engaging portion 30 exit could encourage a cutting action with traditional devices, for example a blade, by dishonest persons who intend on separating the label from the object whereto it is attached in order to elude the security devices used for reporting any attempt at theft.

In order to fulfil the abovementioned function, the anti-retracting protuberance 32 engages with the aforementioned face 46 of the protuberance 42 which is also positioned recessed in relation to the corresponding body of the housing 26 so that the engaging portion 32 of the band is arranged, during use, entirely within the housing 26. A main advantage of the present invention concerns detaching the label from the object whereto it is attached which, according to the teachings of the present invention, is performed easily and rapidly, and also allows reuse of the rectangular body of the label 18 containing the anti-theft device.

Thus, provision has been made to create a specific tool or device to rapidly and easily perform the operation of disengaging.

Figure 5:
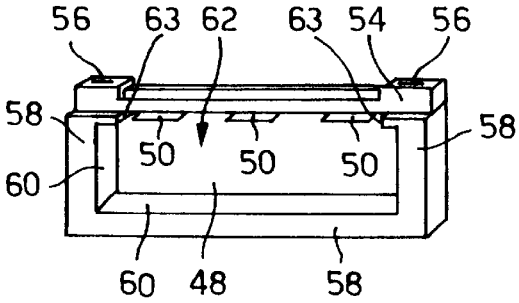
FIG. 5 is a perspective view of a tool which is particularly suitable for cutting the band and freeing the label from the article whereto it is attached.
Figure 6:
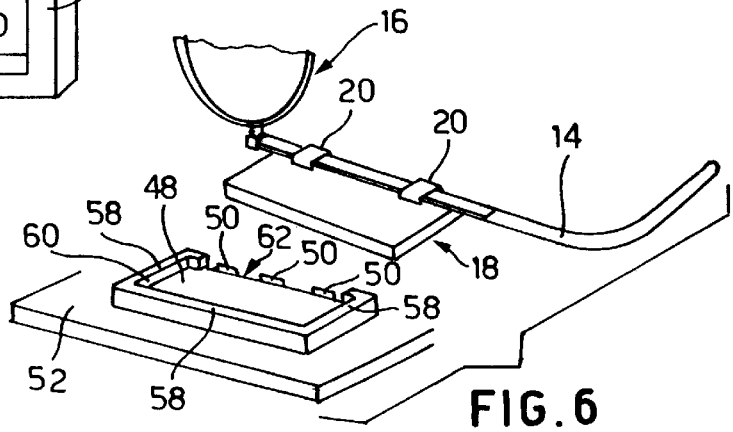
FIG. 6 is a perspective view showing an action of disengaging of the label from the object whereto it is attached.

As shown in FIGS. 5 and 6, the tool for detaching the aforementioned label from the article comprises a base 48 for support of the body of the label and cutting means in the form of blades 50, aligned one with the other, extending perpendicularly to the support base 48 so as to engage, following pressure exerted on the body of the label, with the first engaging portions 30 of the bands 20 for cutting of the bands.

Support base 48 is formed on the upper face of a support block 52 having a generally rectangular prismatic shape, and the blades 50 are connected by suitable support means comprising a locking element 54 which secures, under the effect of thrust screws 56, the blades 50 against an opposing wall of the support block 52.

The support block comprises metal, for example brass, and also comprises a housing suitable for receiving the body of the label in order to maintain position of the label during the cutting operation.

The housing comprises a series of lateral walls 58 which extend perpendicularly to the support base 48 and define, with their faces 60 which are turned towards the interior of the housing, a shaped profile suitable for receiving cross-section of the body of the label 18.

In the front wall of the housing there is also an opening 62 between whose side edges 63, during cutting, the projections defining the housings 26 of said body of the label are housed.

The cutting blades 50 are provided exactly at the opening 62 in the shaped profile of the housing.

Each cutting blade 50 also extends from the support base 48 for a height equal at least to the thickness of the engaging portion 30 in a suitable position for achieving complete shearing of the engaging portion 30.

To perform cutting of the engaging portion 30 of the band it is sufficient, therefore, to rest the body of the label on the support base within the corresponding shaped profile so that the blades 50 rest on the respective bands at the engaging portion 30 of each of the bands and to press the blades 50 and engaging portions 30 together until the engaging portions 30 are cut.

After shearing the engaging portions 30 of the band, it is possible to remove the band from the side opposite the side of insertion of the blade, thus freeing the article 14.

The bands 20 can therefore be removed from the respective prismatic body 18 which holds the anti-theft device, in view of reuse of the prismatic body 18 in combination with new bands.

It must be understood that what has been described with reference to the preferred embodiments of the present invention has been given purely by way of a non-limiting example of the principle claimed, and that the invention is to be defined by the appended claims when read in light of the specification and accorded their full range of equivalence, with changes and modifications being apparent to those of skill in the art.

What is claimed is:

1. A label which can be attached to an article for the emission of an alarm signal, the label comprising:

a label body capable of containing means which can be perceived by suitable detecting apparatus for the emission of the alarm signal;

a first band for attachment of the article to said label body; and means for restraining relative movement between said first band and said label body;

said means for restraining comprising, on said label body, a first housing suitable for being entered by an end section of said first band which is engaged both by said first housing and by an intermediate section of said first band, said end section and said intermediate section being compressively opposed to each other in said first housing, said first band having securing toothing protecting from a first longitudinal surface of said end and intermediate sections, said securing toothing on said end and said intermediate sections being mutually engaged by compressive contact in said first housing and blocking relative movement of said end and said intermediate sections of said first band in said first housing in a disengagement direction to preclude disengagement of said first band from the article.

2. A label according to claim 1, wherein said label body further comprises a second housing suitable for being entered by a second band for attachment of the article to said label body, said second band and said second housing being designed and adapted to attach the article to said label body in the same manner as the coaction of said first housing and said first band.

3. A label according to claim 1, wherein a portion of said first band that engages said first housing is accessible from an area outside said first housing so as to allow cutting and removal of said first band from said label body.

4. A label according to claim 1, wherein said first housing comprises a first opening, and wherein said first band comprises a first engaging portion that is adjacent to an end of said first band and that is in said first opening so as to be accessible from an area outside of said first housing when the first band is engaged by the first housing and the intermediate section.

5. A label according to claim 4, wherein said first band further comprises a second engaging portion longitudinally separated from said first engaging portion so as to engage with said first housing in such a way as to prevent retraction of said first band from said first housing.

6. A label according to claim 5, wherein said first engaging portion and said second engaging portion respectively comprise a first and a second protuberance on said first band extending in a direction perpendicular to a longitudinal direction of said first band, said first housing comprising engaging faces for engaging said first and second protuberances, said engaging faces being recessed in relation to an external edge of the first opening to allow, in an engaged condition, said first and second engaging portions to be entirely contained in said first opening.

7. A label according to claim 2, wherein said first and second housings extend from a same side of said label body so as to be aligned adjacently side-by-side in a direction perpendicular to an insertion direction of said end section into said first housing.

8. A label according to claim 1, wherein said securing toothing comprises a plurality of longitudinally spaced teeth, each of said plurality of longitudinally spaced teeth having a shape of a saw tooth in the longitudinal direction including a longitudinal slanted slide section and a transverse end blocking section perpendicular to said first longitudinal surface, wherein by pulling said first band in a tightening direction opposite to said disengagement direction to secure said first band around a portion of the article, compressively opposing teeth of said end section and said intermediate section have respective longitudinal slanted slide sections arranged so as to allow relative movement of said first band in said tightening direction around the article, wherein pulling said first band in said disengagement direction results in said transverse end blocking section of each of said end section and said intermediate section being brought into contact with each other within said first housing so as to prevent any relative movement of said end section and said intermediate section in said disengagement direction.

9. A label according to claim 1, wherein said securing toothing comprises a plurality of teeth having one tooth of said plurality of teeth on said end section and one tooth of said plurality of teeth on said intermediate section reciprocally engaged in said first housing.

10. A label according to claim 9, wherein at least two teeth on each of said end section and said intermediate section are reciprocally engaged in said first housing.

11. A label according to claim 6, wherein said first and second protuberances project from a second longitudinal surface opposite to said first longitudinal surface.

12. A device for detaching the label according to claim 1 from the article whereto the label is attached, the device comprising:

a support base for said label body; and cutting means extending perpendicularly to said support base, said cutting means being designed and adapted to cut said first band where said first band engages said first housing.

13. A device according to claim 12, wherein perpendicularly to said support base, a shaped profile extends, said shaped profile being suitable for receiving the profile of said label body, said shaped profile having a side opening wherein said first housing is exposed to said cutting means.

14. A device according to claim 12, wherein said cutting means comprise a cutting blade, said cutting blade extending from said base for a height equal to a thickness of said first band to achieve complete shearing of said first band.

15. A device according to claim 12, further comprising a support block with a general prismatic shape having said support base and said cutting means on said support block.

16. A security label for attaching to an article, the security label comprising:

a label body having a first housing with a first engaging portion; and a first band for attachment of the article to said label body, said first band having securing teeth projecting from a first longitudinal surface, and second and third engaging portions longitudinally separated from each other and that engage said first engaging portion, said first band further having an end section that is engaged both by said first housing and by an intermediate section of said first band when said end section and said intermediate section are compressively opposed to each other within said first housing, said securing teeth on said end and said intermediate sections of said first band being mutually engaged by compressive contact within said first housing so as to block relative movement of said end and said intermediate sections of said first band within said first housing in a disengagement direction to preclude loosening of said first band from the article.

17. The label of claim 16, wherein said first, second, and third engaging portions are protuberances extending in a direction perpendicular to a longitudinal direction of said first band, said second and third protuberances projecting from a second longitudinal surface opposite to said first longitudinal surface.

18. A cutting device for removing a security label having a label body, and a band for attachment of the article to the label body, and means for restraining relative movement between the band and the label body, the means for restraining comprising, on the label body, a housing suitable for being entered by an end section of the band which is engaged both by the housing and by an intermediate section of the band to define an engaging section, the end section and the intermediate section being compressively opposed to each other within the housing, the hand having securing toothing projecting from a longitudinal surface, the securing toothing on the end and the intermediate sections of the band being mutually engaged by compressive contact within the housing so as to block relative movement of the end and the intermediate sections of the band within the housing in a disengagement direction to preclude disengagement of the band from the article to be secured, the cutting device comprising:

a support base for the label body; and cutting means extending perpendicularly to a surface of said support base, said cutting means being designed and adapted so as to cut the engaging section of the band.

* * * * *